US005161516A

United States Patent [19]

Ekstrom

[11] Patent Number: 5,161,516

[45] Date of Patent: Nov. 10, 1992

[54] COMPRESSED GAS GUN

[76] Inventor: Glen Ekstrom, 167 Cherry St., Suite 286, Milford, Conn. 06460

[21] Appl. No.: 592,349

[22] Filed: Oct. 3, 1990

[51] Int. Cl.[5] ..... F41B 11/00

[52] U.S. Cl. ..... 124/73; 124/31

[58] Field of Search ..... 124/70, 71, 73, 31

[56] References Cited

U.S. PATENT DOCUMENTS

| | | | |
|---|---|---|---|
| 749,619 | 1/1904 | Benjamin . | |
| 2,238,384 | 4/1941 | Feltman | 124/73 X |
| 2,450,029 | 9/1948 | Wells | 124/73 X |
| 2,839,862 | 6/1958 | Hanshaw | 124/73 X |
| 3,445,069 | 5/1969 | Druge | 124/73 X |
| 3,680,540 | 8/1972 | Stengl | 124/73 |
| 3,788,198 | 1/1974 | Hale . | |
| 4,163,439 | 8/1979 | Chiba | 124/70 |
| 4,865,009 | 9/1989 | Ford et al. | 124/76 |
| 4,936,282 | 6/1990 | Dobbins et al. | 124/74 |

FOREIGN PATENT DOCUMENTS 605794 11/1934 Fed. Rep. of Germany ..... 124/73

*Primary Examiner*—Randolph A. Reese
*Assistant Examiner*—Jeffrey L. Thompson
*Attorney, Agent, or Firm*—Dilworth & Barrese

[57] ABSTRACT

A compressed gas gun having a trigger mechanism including a body member having a passage through which a valve stem passes. A trigger arm is pivotably secured to the body member and includes a finger grip and a cam surface for bearing against a wall of the internal chamber of the gun to move the body member rearwardly upon actuation of the trigger arm. Rearward movement of the body member moves the valve stem rearward to overcome a spring force to release gas through the valve stem into the barrel of the gun to propel a projectile, such as a paint ball, arrow or harpoon.

23 Claims, 6 Drawing Sheets

COMPRESSED GAS GUN

BACKGROUND OF THE INVENTION

1. Field of the Invention

The present invention relates to compressed gas powered guns, and more particularly, to trigger mechanisms used for firing such guns.

Compressed gas guns employing $CO_2$ or compressed air to fire projectiles are well known in the art. The projectiles typically comprise arrows or harpoons, and also include gelatin-encased balls which are filled with a liquid such as paint. These guns generally are activated by a complex mechanical valving system which utilizes conventional hammer and sear-type triggering mechanisms which are modified for gas discharging valves. The impact action of the hammer is converted to a translational movement of the valve to result in a gas discharge through the valve stem to fire the projectile.

2. Discussion of the Prior Art

In the prior art, various trigger mechanisms for gas powered guns are disclosed which utilize complex spring-biased constructions to open and close a valving system to effect the gas discharge to fire the projectile from the gun. These trigger arrangements, however, are subject to several disadvantages, and in many cases require specialized assembly in manufacture and result in increased manufacturing costs. Furthermore, the complexity of the trigger mechanism may eventually result in a breakdown of the interconnections of the numerous moving parts, often requiring expensive and time-consuming repairs to the gun.

Hale, U.S. Pat. No. 3,788,298, discloses a gun for firing projectiles such as paint balls using a compressed gas source such as a $CO_2$ cartridge. A conventional valve stem is biased by a spring into a closed position, while a hammer member is spring biased away from valve stem and locked in a ready position by a pivotable sear member. A spring biased finger actuated trigger is pulled rearward to release the sear, which in turn releases the hammer, which is propelled rearward by the spring to impact against a flange on the valve stem. This impact overcomes the biasing force of the valve stem spring to force the stem rearward to allow for discharge of compressed gas through the valve stem to propel a paint ball projectile.

Chiba, U.S. Pat. No. 4,163,439, discloses a trigger mechanism for opening a gas delivery valve in a compressed gas powered gun. A pivotable finger actuated trigger and latch member are provided which engage a valve rod. The valve rod is spring biased to close a gas passage which leads to a gas chamber. The chamber is pressurized by pumping compressed gas into the chamber at a pressure which overcomes a spring biased check valve. When the trigger is pulled, the pressure in the chamber overcomes the rod spring force to move the rod to a position which vents the gas in the chamber to fire a projectile.

Ford et al., U.S. Pat. No. 4,865,009, discloses a gas discharge system for an airgun in which compressed gas is provided to a discharge chamber prior to firing of the gun. As the trigger is pulled, a pivotable release mechanism is moved out of engagement with a spring biased block, and the block is forced rearward. As the block moves, a shaft member is moved with the block past a discharge port so that compressed gas is discharged from the chamber to fire a projectile.

Dobbins et al.; U.S. Pat. No. 4,936,282, discloses a gas powered gun for firing projectiles such as paint balls. A cocking and loading mechanism is provided, as well as a hammer and sear-type trigger mechanism for firing the gun. As the trigger is pulled, the sear pivots away from the spring biased hammer, which moves rearward, which also moves a bolt member rearward to allow a paint ball to drop into the barrel. As the hammer continues to move rearward, the valve stem flange is contacted and driven rearward to discharge compressed gas through the stem to fire the paint ball projectile.

The novel compressed gas gun pursuant to the present invention obviates the disadvantages encountered in the prior art and provides an efficient triggering mechanism for actuating the gun which eliminates many moving parts, resulting in an easy to manufacture and relatively inexpensive device. The trigger mechanism provides a camming action which urges the valve stem against the force of a biasing spring to communicate the stem passage with the gas chamber to instantaneously propel a projectile such as a paint ball from the gun.

SUMMARY OF THE INVENTION

The present invention provides a novel trigger mechanism for a compressed gas gun which utilizes, for example, a compressed gas source such as $CO_2$ or compressed air. The conventional hammer and sear members are eliminated, and an easy to assembly and manufacture trigger mechanism is provided for incorporation into a compressed gas gun. The use of such a mechanism in a compressed gas gun reduces the number of movable cooperating elements, resulting in simpler maintenance and reduced breakdowns in performance.

Furthermore, the novel trigger mechanism of the present invention eliminates the possibility of accidental discharge of the compressed gas gun in which the trigger mechanism is incorporated, since there are no latching or tensioning components within the trigger mechanism as in conventional hammer and sear type mechanisms. Guns having conventional trigger devices employing the hammer and sear arrangement are in a constant volatile condition, since the hammer is generally spring tensioned and latched within the gun by the sear. Accidental discharge is a real possibility, since dropping or banging the gun may unlatch the sear to release the hammer, thus discharging the weapon. The present invention eliminates the possibility of accidental discharge by eliminating the hammer and sear, and allows for discharge of the gun only upon pulling the trigger arm. With this arrangement, even the safety mechanism required on conventional guns is eliminated since latching and tensioning is not present. The trigger mechanism of the present invention is in itself a manual safety system, since the only possibility of discharge is upon actuation of the trigger arm.

The trigger mechanism of the present invention consists of a body portion having a bore or passageway through which a valve stem passes. A trigger member is pivotably secured to the body portion, and is provided with a passageway which is axially aligned with the passageway of the body portion so that the valve stem passes therethrough. The trigger member has a finger grip at an end opposite the pivotable connection point, and is further provided with a camming surface at the end adjacent the pivotable connection point.

The body portion is generally cylindrical in shape to conform to the shape of the interior chamber of the gun in which the trigger mechanism is used. The shape is, of course, determined by the shape of the interior chamber and the body portion is maintained in sliding contact with the walls of the chamber.

The valve stem passes through the body portion and provides communication between the gas accumulation chamber and the barrel. The valve stem includes a shoulder portion which abuts an end of the body portion of the trigger member. Preferably, the shoulder portion is accommodated in a cut-out region or indentation in the body portion to radially stabilize the valve stem. The valve stem is further secured to the interior chamber of the gun by a threaded block member, which has a bore through which the stem passes. The stem is capped at its end adjacent gas entry holes which allow for the passage of gas from the gas accumulation chamber to the barrel. The cap also serves as a seat for the block member which seals the gas entry holes when the trigger mechanism is in the unactuated position.

In the construction of a gun employing the present trigger mechanism, the interior chamber is provided with a bearing wall which separates the barrel from the valve chamber. This bearing wall is provided with a passage through which the valve stem extends into the barrel in sliding contact with passage walls in the bearing wall. The cap end of the stem is biased forward by a spring which extends into the gas accumulation chamber, and the biasing force urges the front face of the body portion of the trigger mechanism against the chamber bearing wall. In this position, the cam surface of the trigger member rests against the bearing wall in the same plane as the front face of the body portion.

To fire the gun, the trigger member is drawn rearward through the application of pressure on the finger grip, thus pivoting the trigger member about the pivot point on the body portion of the trigger mechanism. This results in the camming surface contacting the bearing wall to push the body portion rearwardly. Since the rear wall of the body portion abuts the shoulder of the valve stem, the entire stem is urged rearwardly against the force of the spring. This breaks the seal between the stationary block member and the end cap, which allows a burst of compressed gas to pass through the gas entry holes from the accumulation chamber through the valve stem to the barrel to propel the projectile. After firing, the pressure on the finger grip is released, and the spring forces the entire mechanism forward, thus resealing the accumulation chamber as the end cap seats against the block member.

Accordingly, it is an object of the present invention to provide a compressed gas gun utilizing a simple and efficient trigger mechanism which reduces the number of moving parts required to fire the gun.

It is a further object of the present invention to provide a compressed gas gun having a trigger mechanism which eliminates the complex conventional hammer and sear mechanism for firing a gun.

It is yet another object of the present invention to provide a compressed gas gun having a trigger mechanism in which the gear ratio may be set as desired to lessen or increase the force necessary to fire the gun.

It is still a further object of the present invention to provide a compressed gas gun having a trigger mechanism utilizing a camming surface and bearing member to actuate the gun and fire a projectile.

BRIEF DESCRIPTION OF THE DRAWINGS

The foregoing objects and other features of the invention will become more readily apparent and may be understood by referring to the following detailed description of an illustrative embodiment of the compressed gas gun and its novel trigger mechanism, taken in conjunction with the accompanying drawings, in which.

DETAILED DESCRIPTION OF THE PREFERRED EMBODIMENTS

Figure 1:
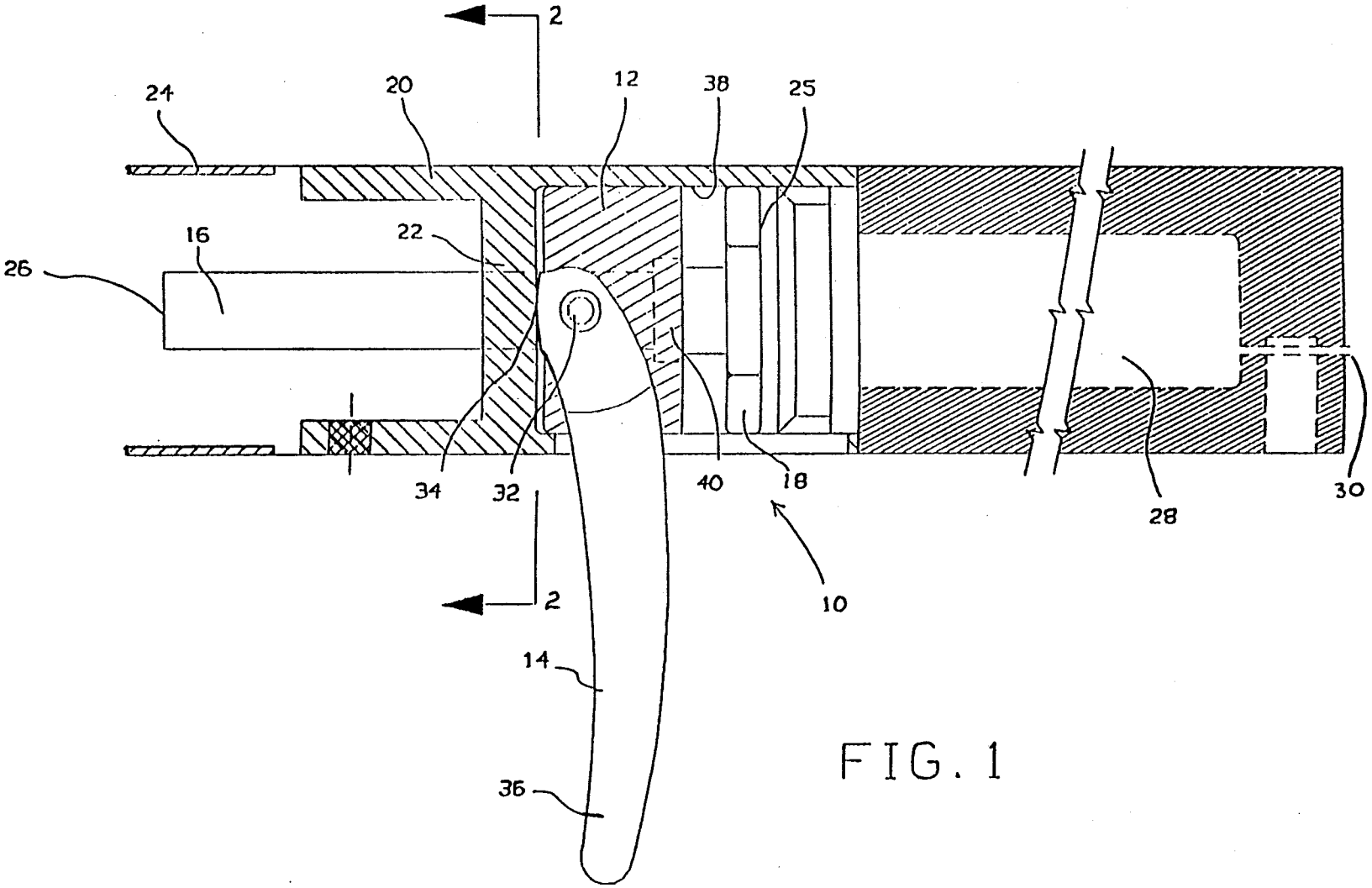
FIG. 1 illustrates a cut away side sectional view of a compressed gas gun showing the assembly of the trigger mechanism of the present invention.

Referring now in specific detail to the drawings, in which identical reference numerals identify similar or identical elements throughout the several views, FIG. 1 shows a preferred embodiment of the compressed gas gun utilizing the trigger mechanism of the present invention. The trigger mechanism 10 essentially consists of a body member 12 to which trigger arm 14 is pivotably secured about pivot points 32. Body member 12 has a passage through which valve stem 16 passes, valve stem 16 being conventional in construction and including shoulder portion 40 and mounting block 18. Valve stem 16 terminates in an end cap 52 (as best seen in FIG. 3).

Trigger mechanism 10 is positioned within a chamber 20 of the compressed gas gun and slidably engages inner wall 38 of chamber 20. Body member 12 rests against valve wall 22 which separates chamber 20 from barrel 24, and wall 22 is provided with a passage to allow valve stem 16 to pass therethrough into barrel 24. Valve stem 16 terminates in barrel 24 at gas discharge outlet 26.

Figure 2:
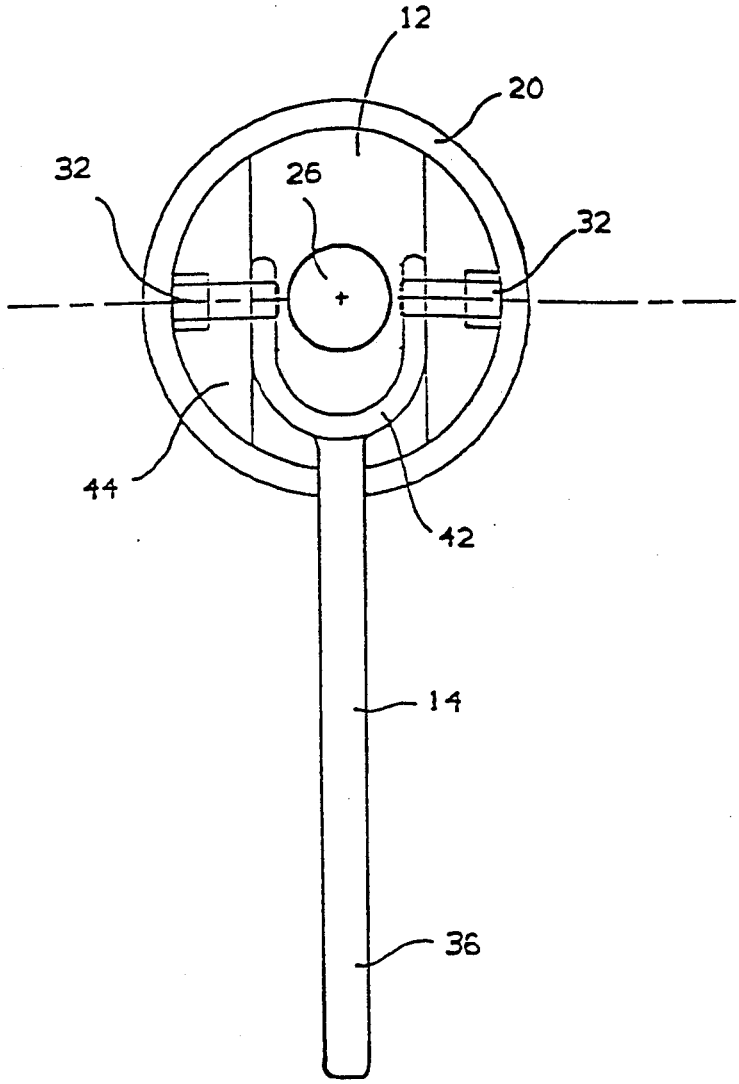
FIG. 2 illustrates an end view taken along lines 2—2 of FIG. 1 showing the compressed gas gun with the trigger mechanism of the present invention positioned within the chamber of the gun.
Figure 3:
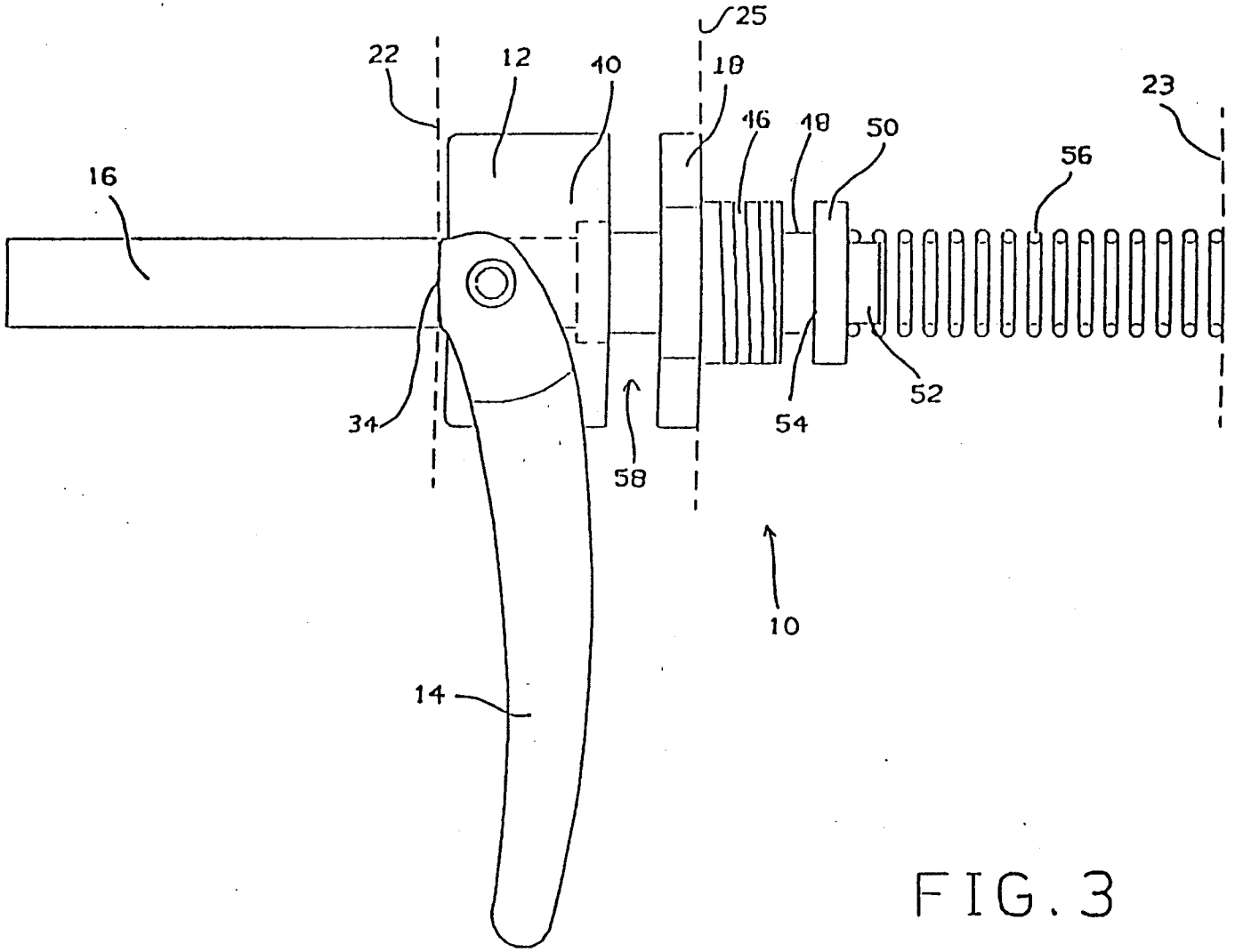
FIG. 3 illustrates a perspective side view of the trigger mechanism of the present invention in the at-rest position.

Mounting block 18 is fixedly secured, preferably by screwing threads 46 (as best seen in FIG. 3), into a cooperating threaded reception area in chamber 20 (not shown) to secure valve stem 16 in concentric arrangement with barrel 24 (see FIG. 2).

Figure 5:
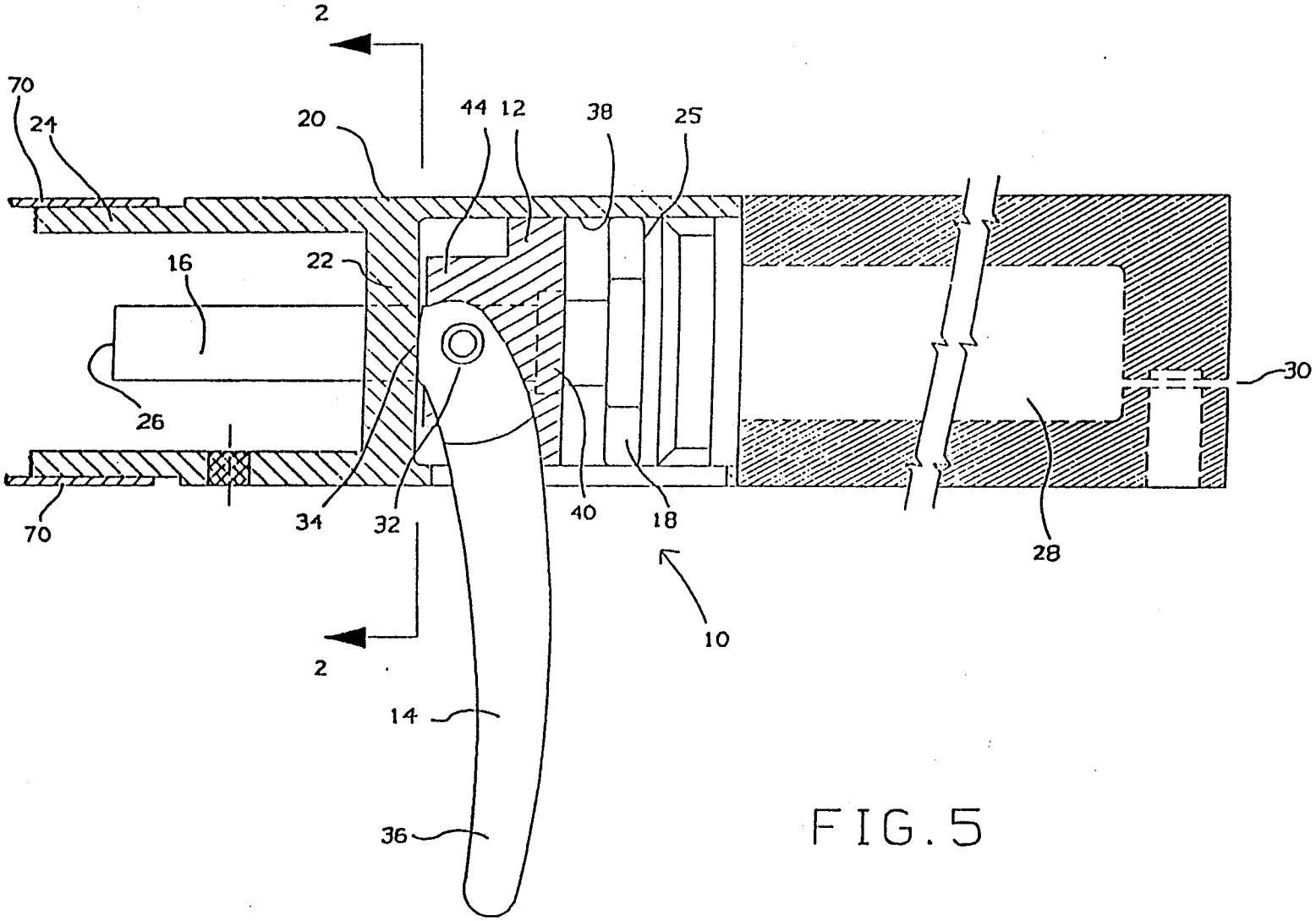
FIG. 5 illustrates a cut-away side sectional view of a compressed gas gun showing the assembly of the trigger mechanism of FIG. 1 with a hollow arrow loaded therein.
Figure 6:
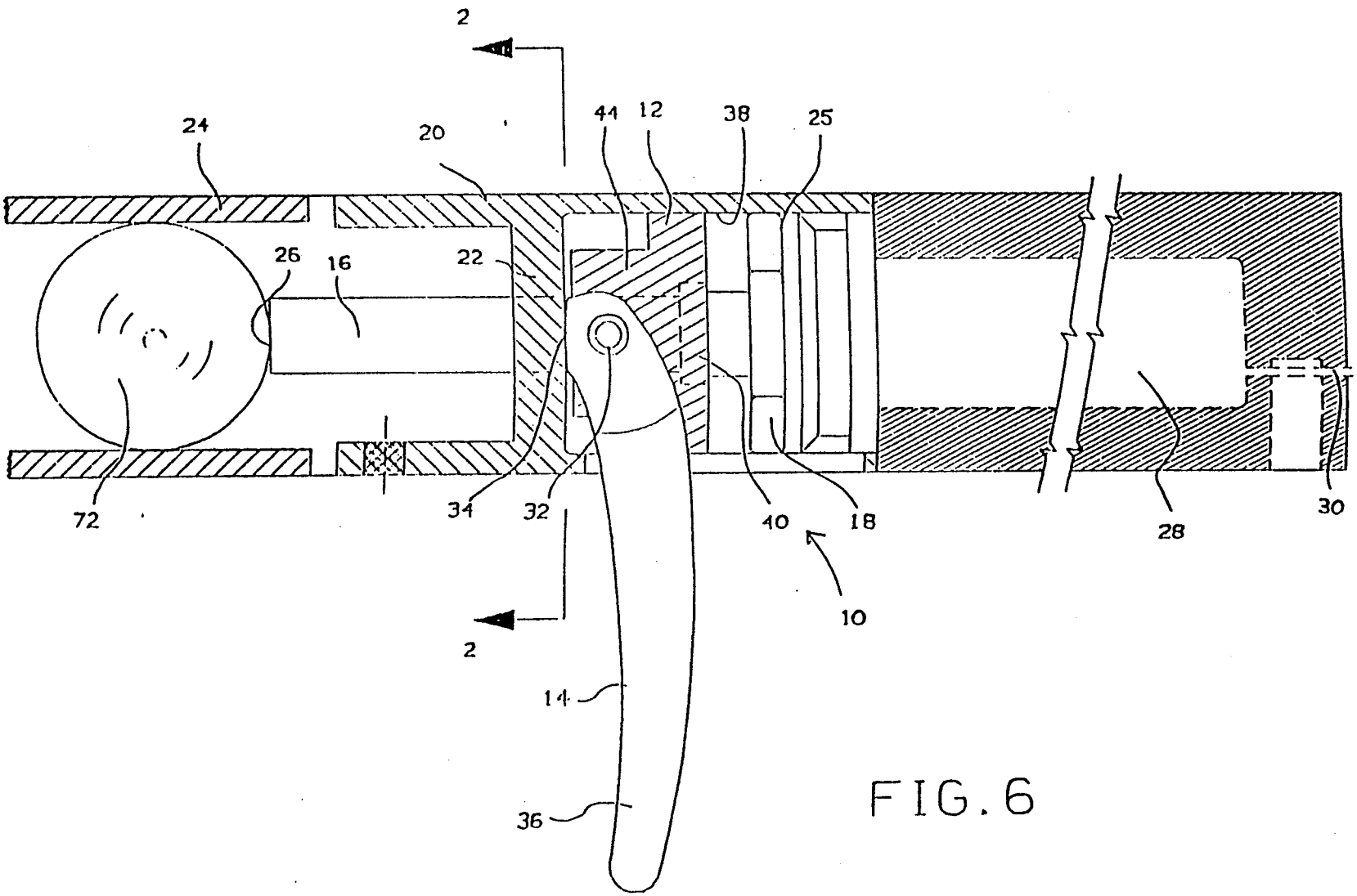
FIG. 6 illustrates a cut-away side sectional view of a compressed gas gun showing the assembly of a trigger mechanism of FIG. 1 with a paint-filled gelatin ball loaded therein.

As best seen in FIG. 2, trigger arm 14 preferably is provided with a U-shaped portion 42 at its end proximate the body member 12, so that the valve stem may pass through the U-shaped portion 42. Trigger arm 14 is pivotably secured at pivot points 32 to axially extending side walls 44 of body member 12, and terminates at a distal end in a finger grip portion 36 for gripping and pulling the trigger arm to actuate and fire the compressed gas gun. Side walls 44 may be internally disposed within body 12 or extend outwardly therefrom, as seen in FIGS. 5 and 6.

Turning to FIG. 3, the trigger mechanism 10 is shown in its at-rest position, with the end wall of gas accumulation chamber 28 shown diagrammatically as dotted line 23, while the valve wall 22 is also shown diagrammatically as a dotted line, as is the end wall 25 of chamber 20. In this position, spring member 56 engages end cap 52 at collar 50, and extends to wall 23 of gas accumulation chamber 28. Spring 56 urges valve stem 16 forward into barrel 24 through mounting block 18, and consequently forces body member 12 into engagement with wall 22. Body member 12, is provided with an indentation or recessed region to accept shoulder portion 40 of valve stem 16, although the indentation may be eliminated and shoulder portion 40 may engage the end face of body member 12 if so desired.

When the trigger mechanism 10 is in this position, the spring force is sufficient to create a seal between collar 50 of end cap 52 and ring portion 48 of mounting block 18. The seal may be effected by a tapered seating interengagement between the ring 48 and collar 50, or may include other means such as resilient gaskets, O-rings or the like. The seal, generally shown at 54, prevents the passage of compressed gas from gas accumulation chamber 28 through valve stem 16 to barrel 24. Furthermore, in the position shown in FIG. 3, an air gap is maintained at 58 between body portion 12 and mounting block 18.

Figure 4:
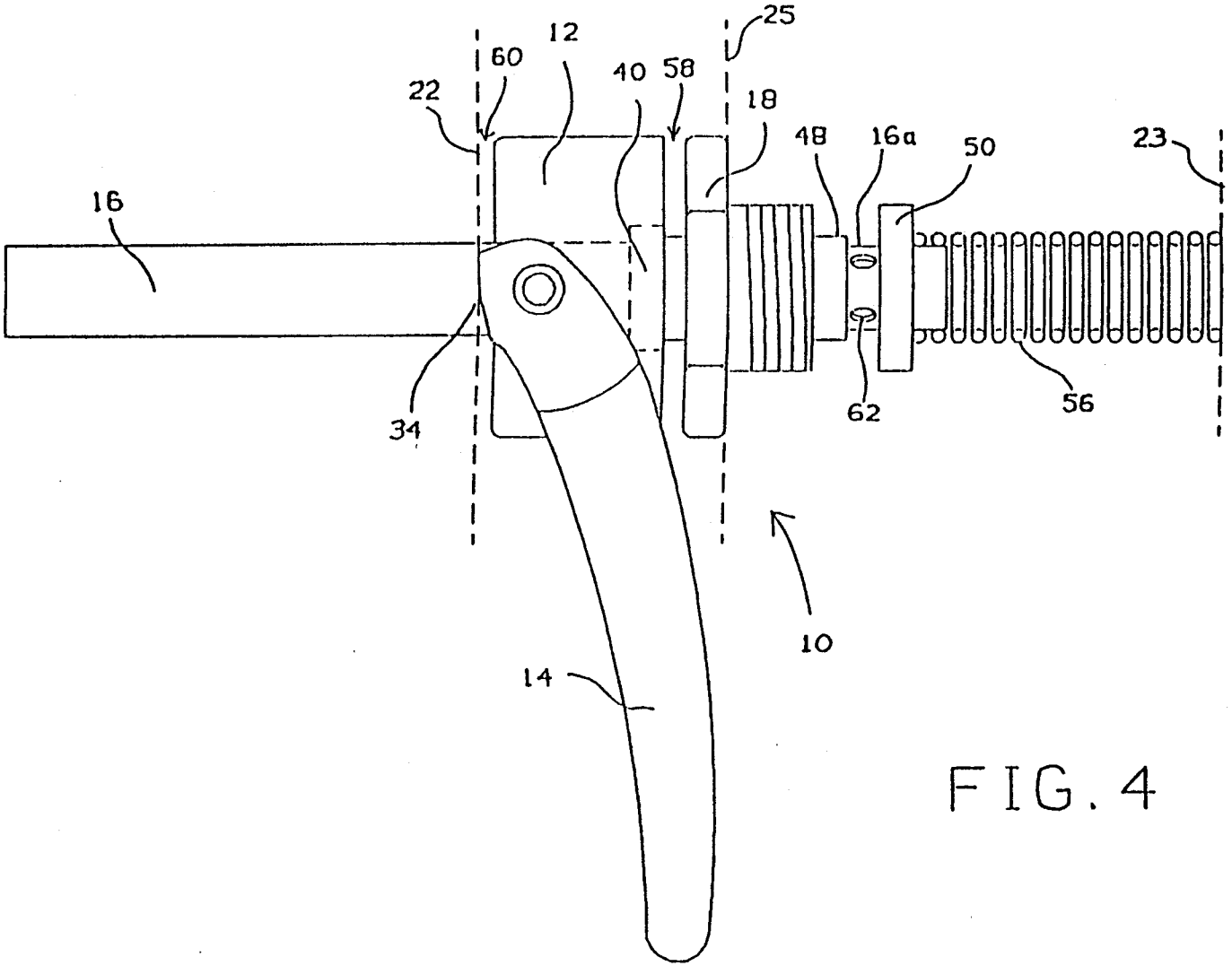
FIG. 4 illustrates a perspective side view of the trigger mechanism of the present invention similar to FIG. 3 except with the trigger mechanism in the fired position.

In the position shown in FIG. 3, trigger arm 14 is in the at-rest position with cam surface 34 resting against wall 22 in the same plane as the front face of body member 12. To fire the compressed gas gun, as best seen in FIG. 4, trigger arm 14 is gripped at finger grip 36 and pulled rearwardly away from barrel 24. Trigger arm 14 pivots about pivot points 32 and cam surfaces 34 bear against wall 22. The bearing of cam surfaces 34 against wall 22 urges body member 12 rearwardly within chamber 20, as body member 12 slides along surface 38. This action forces valve stem 16 rearwardly as shoulder portion 40 moves with body member 12, so that stem 16 slides through mounting block 18. Gap 58 is eliminated as body member 12 contacts mounting block 18, and gap 60 is created between wall 22 and the front face of body member 12.

As valve stem 16 is forced rearwardly, the force of spring 56 is overcome by compressing spring 56 between end cap 52 at collar 50 and end wall 23 of gas accumulation chamber 28. As the stem moves, the seal between collar 50 and ring 48 is broken, exposing the gas inlet holes 62 at the portion of valve stem 16 designated as 16*a*. Any number of holes 62 may be used, and at least 3 are preferred. Compressed gas from gas accumulation chamber 28 passes through inlet holes 62, through stem 16 and exits stem 16 at outlet 26 into barrel 24 to propel a projectile such as a paint ball, arrow, or any other projectile out of the gun. Once fired, the trigger arm 14 is released and the spring 56 expands to force the collar 50 back into sealing engagement with ring 48, as the stem 16 and body member 12 are urged forward into the rest position shown in FIG. 3. Of course, as collar 50 engages ring 48, gas inlet holes 62 are sealed to prevent the further passage of compressed gas.

Cam surface 34 of trigger arm 14 may be constructed so as to have a specific gear ratio, such as between 5:1 and 25:1, and preferably the gear ratio is 20:1. The surface may also be constructed to have varying gear ratios, such that a first ratio may be provided which corresponds to the force necessary to break the seal between collar 50 and ring 48, while a second ratio may also be provided which corresponds to the force of travel of the trigger arm after the seal is broken. It is preferred that the first ratio in this case is 15:1 and the second ratio is 8:1.

FIGS. 5 and 6 show the gas gun of FIG. 1 having a hollow arrow 70 and a paint-filled gelatin ball 72 loaded therein, respectively. Actuation of trigger mechanism 10 as described above effects firing of the gun to propel arrow 70 and ball 72 from barrel 24 of the gun.

The compressed gas gun employing the novel trigger mechanism of the present invention is a simple to manufacture and easy to maintain gun which eliminates many of the interconnected moving parts of the complex conventional gun having traditional hammer and sear-type trigger mechanisms. While the invention has been particularly shown and described with reference to the preferred embodiments, it will be understood by those skilled in the art that various modifications and changes in form and detail may be made therein without departing from the scope and spirit of the invention. Accordingly, modifications such as those suggested above, but not limited thereto, are to be considered within the scope of the invention.

What is claimed is:

1. A trigger mechanism for a compressed gas gun, comprising:

a body member having a passage therethrough for slidably engaging a hollow, tubular valve stem passing therethrough, said body member having a first end wall contacting an end wall of a barrel of said gun, and a second end wall contacting an integral shoulder of said valve stem, said valve stem supported by a mounting block having a passage to allow said valve stem to slidingly pass therethrough and an end cap on said valve stem sealingly engaging said mounting block, said trigger mechanism including biasing means to bias said valve stem towards said barrel end wall; and an arm member pivotably mounted to said body member adjacent said first end wall, said arm member including a cam surface at one end of said arm member and a finger grip at a second end of said arm member, a forwardmost point on said cam surface being movable from a first plane which is spaced from the plane of said body member first end wall to a second plane parallel to said body member first end wall, said cam member contacting said barrel end wall when in said second plane;

wherein said arm member pivots to contactingly engage said cam surface with said barrel end wall to drive said body member away from said barrel end wall against said biasing means, such that movement of said body member moves said shoulder of said valve stem to force said end cap out of sealing engagement with said mounting block to allow compressed gas to flow through said hollow tubular valve stem.

2. A trigger mechanism according to claim 1, wherein said end cap is positioned adjacent a compressed gas source such that movement of said valve stem to force said end cap out of sealing engagement with said mounting block allows compressed gas to flow through said valve stem.

3. A trigger mechanism according to claim 1, wherein said compressed gas source comprises $CO_2$.

4. A trigger mechanism according to claim 1 wherein said compressed gas source comprises compressed air.

5. A trigger mechanism according to claim 1, wherein said biasing means comprises a spring which urges said end cap into sealing engagement with said mounting block to prevent the flow of compressed gas.

6. A trigger mechanism according to claim 1, wherein said cam surface has a convex shape which contacts said barrel end wall to move said body member away from said barrel end wall.

7. A trigger mechanism according to claim 1, wherein said cam surface contacts said barrel end wall at one or more points to move said body member away from said barrel end wall.

8. A trigger mechanism according to claim 1, wherein said body member is provided with a pair of axial extensions to which said arm member is pivotably secured, such that an end of each of said extensions contacts said barrel end wall prior to application of a force to said finger grip.

9. A trigger mechanism according to claim 1, wherein said trigger mechanism functions as a safety device for said compressed gas gun to avoid accidental discharge, said trigger mechanism being actuatable only upon the application of a pivoting force to said arm member.

10. A trigger mechanism for a compressed gas gun, said gun including a handle, a barrel extending from said handle, a compressed gas source, and a valve means within said handle responsive to said trigger mechanism for communicating said compressed gas source with said barrel to propel a projectile therefrom, said trigger mechanism comprising:

a body portion having a passage therethrough, said valve means passing through said passage; and a trigger arm, said trigger arm having a finger grip at a first end and a cam surface at a second end, said trigger arm being pivotably secured to said body portion;

wherein application of an actuation force on said finger grip pivots said trigger arm relative to said body portion such that said cam surface contacts a boss within said handle to move said body portion and said valve means relative to said boss to momentarily and instantaneously open said valve means to allow compressed gas to flow through said valve means to said barrel to propel a projectile therefrom.

11. A trigger mechanism according to claim 10, wherein said compressed gas source is attached to said handle and communicates with a gas accumulation chamber, said valve means having an inlet disposed within said chamber and an outlet disposed within said barrel.

12. A trigger mechanism according to claim 11, wherein said projectile comprises a hollow arrow positioned over said barrel, said valve means communicating with said barrel and an interior of said arrow.

13. A trigger mechanism according to claim 11, wherein said projectile is a gelatin-encased ball containing paint, said ball being loaded to a position within said barrel adjacent said valve means.

14. A trigger mechanism according to claim 10, wherein said valve means is biased towards said boss within said handle to sealingly close said valve means upon absence of said actuation force.

15. A compressed gas gun for propelling projectiles, comprising:

a handle;

a barrel extending from said handle;

a compressed gas source attached to said handle;

a valve mechanism incorporated within said handle for communicating said gas source with said barrel, said valve mechanism including a gas accumulation chamber, a tubular valve stem having a gas inlet adjacent said chamber and a gas outlet adjacent said barrel, a shoulder integral to said stem, an end cap on said stem at said inlet, a mounting block secured within said handle having a passage to slidably mount said stem to said handle, said block being positioned about said stem between said shoulder and said end cap, and biasing means urging said end cap into sealing engagement with said mounting block to prevent passage of compressed gas from said accumulation chamber to said inlet of said stem; and a trigger mechanism slidably mounted in said housing for actuating said valve mechanism, said trigger mechanism comprising a body member having a passage to allow said valve stem to pass therethrough, said body member having a first end wall parallel to and in abutting contact with an end wall of said barrel, and a second end wall contacting said shoulder of said valve stem, said trigger mechanism further including a trigger arm pivotably secured at a first end to said body member and having a finger grip at a second end remote from said body member and extending from said handle, said first end of said trigger arm having a cam surface for contacting said end wall of said barrel upon pivoting of said trigger arm;

wherein applying actuation pressure to said finger grip pivots said trigger arm to contact said cam surface with said barrel end wall resulting in movement of said body member away from said end wall, said body member engaging said shoulder and moving said valve stem relative to said mounting block to unseat said end cap from said mounting block, allowing said compressed gas to vent from said accumulation chamber through said valve mechanism to said barrel to propel said projectile therefrom.

16. A compressed gas gun according to claim 15, wherein said cam surface comprises a convex surface having at least one contact point adjacent said barrel end wall.

17. A compressed gas gun according to claim 16, wherein said contact point is positioned on said cam surface a predetermined distance from said trigger arm pivot point, said predetermined distance being calculated to determine a gear ratio of said trigger arm.

18. A compressed gas gun according to claim 17, wherein said gear ratio varies from a first ratio to a second ratio, said first ratio corresponding to the force necessary to break the valve seal, and said second ratio corresponding to the force of travel of said trigger arm after said valve seal is broken.

19. A compressed gas gun according to claim 18, wherein said first ratio is approximately 15:1 and said second ratio is approximately 8:1.

20. A compressed gas gun according to claim 17, wherein said gear ratio is 20:1.

21. A compressed gas gun according to claim 15, wherein said gun is an arrow gun for propelling hollow arrows positioned over said barrel, said valve mechanism being responsive to actuation of said trigger mechanism to deliver compressed gas from said accumulation chamber to said barrel to propel said arrow.

22. A compressed gas gun according to claim 15, wherein said projectile comprises a paint-filled gelatin ball, said valve mechanism being responsive to actuation of said trigger mechanism to deliver compressed gas from said accumulation chamber to said barrel to propel said ball.

23. A compressed gas gun according to claim 15, wherein said trigger mechanism functions as a safety mechanism, such that accidental discharge of said gun is avoided, said gun being actuatable only upon manual application of a force to pivot said trigger arm of said trigger mechanism.

* * * * *